United States Patent [19]

Miyashita et al.

[11] 4,437,778

[45] Mar. 20, 1984

[54] TAPE CASSETTE HAVING MEANS FOR ADJUSTING A TAPE SEGMENT LENGTH FOR A THERMAL PRINTER

[75] Inventors: Takao Miyashita, Atsugi; Hidekuni Aizawa; Toru Takamiya, both of Yokohama, all of Japan

[73] Assignee: Sony Corporation, Tokyo, Japan

[21] Appl. No.: 329,700

[22] Filed: Dec. 11, 1981

[30] Foreign Application Priority Data

Dec. 11, 1980 [JP] Japan ..... 55-178144

[51] Int. Cl.[3] ..... B41J 33/14

[52] U.S. Cl. ..... 400/208; 400/234; 400/248

[58] Field of Search ..... 400/194, 195, 196, 196.1, 400/207, 208, 208.1, 229, 234, 248; 242/55, 19 A, 197, 198, 199, 200; 358/75

[56] References Cited

U.S. PATENT DOCUMENTS

| | | | |
|---|---|---|---|
| 1,871,232 | 8/1932 | Foster | 242/199 |
| 3,425,532 | 2/1969 | Dannatt | 400/208 |
| 3,791,608 | 2/1974 | Akashi et al. | 242/199 |
| 3,945,582 | 3/1976 | Yagi et al. | 242/55.19 A |
| 4,019,695 | 4/1977 | Wharam | 242/199 |
| 4,079,827 | 3/1978 | Work | 400/229 X |
| 4,350,452 | 9/1982 | Dials et al. | 400/208 |
| 4,352,575 | 10/1982 | Shore | 400/208 X |
| 4,352,577 | 10/1982 | Chida et al. | 400/196.1 |
| 4,378,566 | 3/1983 | Tsukamura | 358/75 |

FOREIGN PATENT DOCUMENTS

| | | | |
|---|---|---|---|
| 19649 | 12/1980 | European Pat. Off. | 400/196.1 |
| 55-142687 | 11/1980 | Japan | 400/194 |
| 55-142688 | 11/1980 | Japan | 400/196.1 |
| 1312282 | 4/1973 | United Kingdom . | |
| 1358759 | 7/1974 | United Kingdom . | |
| 1471292 | 4/1977 | United Kingdom . | |
| 2037706 | 7/1980 | United Kingdom . | |

OTHER PUBLICATIONS

IBM Technical Disclosure Bulletin, "Carrier Driven Ribbon Feed for Typewriter", Dials et al., vol. 22, No. 12, May 1980, p. 5397.

*Primary Examiner*—Ernest T. Wright, Jr.

*Attorney, Agent, or Firm*—Lewis H. Eslinger; Alvin Sinderbrand

[57] ABSTRACT

A tape cassette for use with a thermal printing apparatus includes a cassette housing; supply and take-up reels rotatably mounted in the cassette housing; tape having a pigment thereon wound about the supply and take-up reels and having a segment extending between the reels, the length of the segment being adjustable; a hollow projecting portion extending from the cassette housing and having a free end at which a first guide pin is connected; a second guide pin moveably mounted, in a sliding or pivotal relation, with respect to the cassette housing for guiding the segment of tape; and optionally, a tape drawing member to which the second guide pin may be connected and which is moveable with respect to the cassette housing for adjusting the length of the segment of tape.

11 Claims, 10 Drawing Figures

TAPE CASSETTE HAVING MEANS FOR ADJUSTING A TAPE SEGMENT LENGTH FOR A THERMAL PRINTER

BACKGROUND OF THE INVENTION

1. Field of The Invention

This invention relates to tape cassettes, and, more particularly, is directed to a tape cassette for use with a printing apparatus of the thermal transfer type.

2. Description of the Prior Art

Apparatus for printing visual information on recording paper in response to an information signal are well-known in the art. One such printing apparatus is of the thermal transfer type in which a pigment is selectively transferred from a tape to a record medium, such as a sheet of paper, by applying thermal energy to localized areas on the tape. As an example, a thermal head assembly may include a plurality of thermally excitable elements which, when activated, transfer the pigment to the paper as an arrangement of dots or other discrete elements.

Generally, the tape used with such printing apparatus is wound about two reels which are then positioned in the apparatus, with the segment of tape extending between the reels being positioned between the thermal head assembly and paper. With such arrangement, however, the reels must individually be positioned in the apparatus and the segment of tape extending therebetween must be accurately positioned between the thermal head assembly and the sheet of paper. It should be appreciated, therefore, that the positioning of the tape and reels in the apparatus can be troublesome, time-consuming and messy. Further difficulties arise when the segment of tape must additionally be positioned between guide rollers or guide pins in the apparatus.

Further, it may be desirable to vary the length of the segment of tape extending between the reels for different apparatus. However, if the tape is contained in, for example, a cassette housing, it is to be appreciated that the segment of tape must always be arranged parallel to the paper when positioned between the thermal head assembly of the apparatus and the sheet of paper, regardless of the length of such segment.

OBJECTS AND SUMMARY OF THE INVENTION

Accordingly, it is an object of this invention to provide a tape cassette for use with printing apparatus that avoids the above-described difficulties encountered with the prior art.

More particularly, it is an object of this invention to provide a tape cassette that can easily be loaded into and unloaded from a printing apparatus.

Another object of this invention is to provide a tape cassette that is adjustable to conform to printing apparatus of different dimensions.

Still another object of this invention is to provide a tape cassette having particular applicability to printing apparatus of the thermal transfer type.

In accordance with an aspect of this invention, a tape cassette for use with printing apparatus includes housing means; first and second reels rotatably mounted in the housing means; a tape having a pigment thereon wound about the reels and having a segment extending between the reels, the length of the segment being adjustable; and guide means movably mounted with respect to the housing means for guiding the segment of tape.

The above, and other, objects, features and advantages of the invention will be apparent in the following detailed description of illustrative embodiments of the invention which is to be read in connection with the accompanying drawing.

DETAILED DESCRIPTION OF THE PREFERRED EMBODIMENTS

Figure 1:
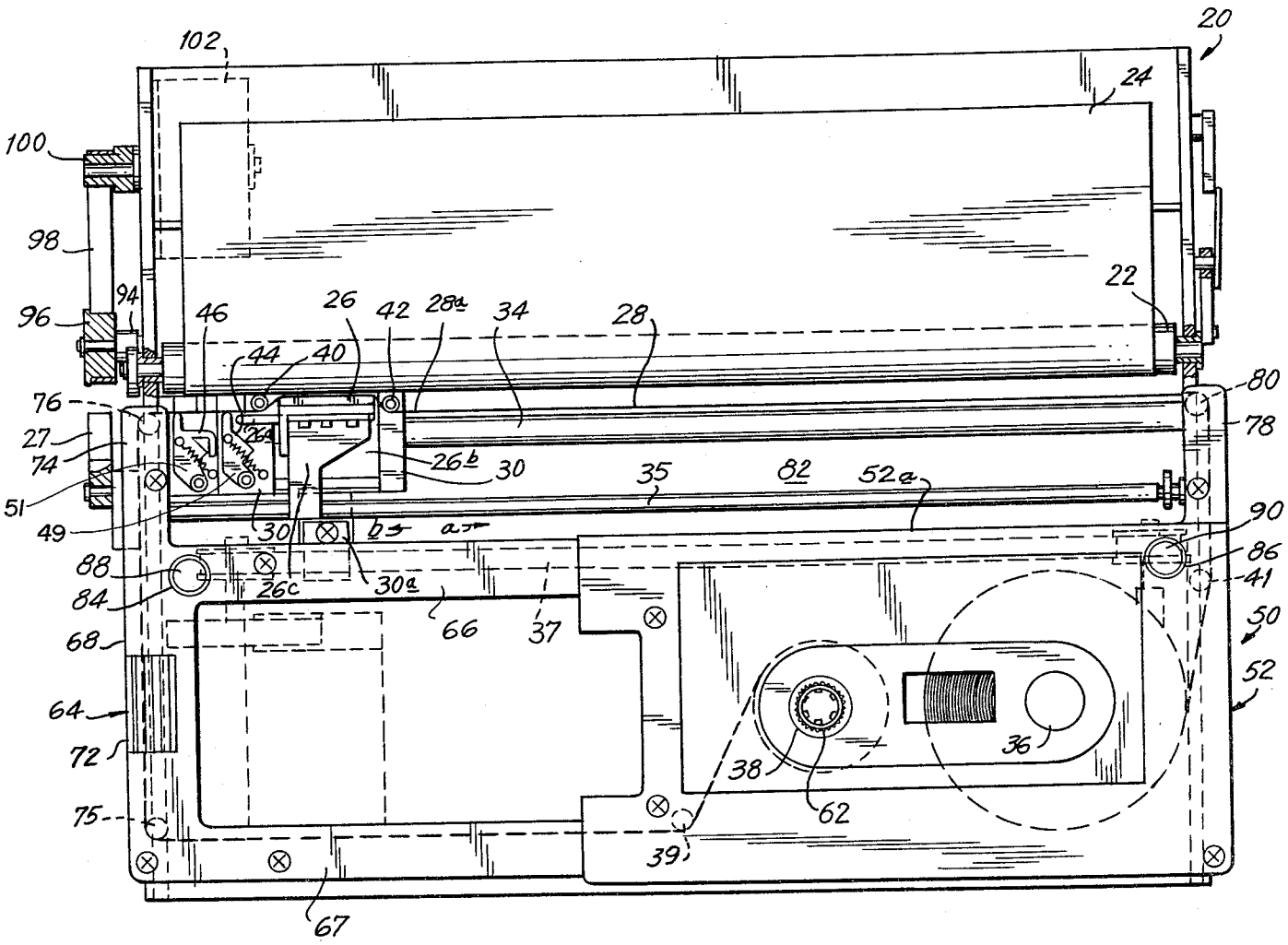
FIG. 1 is a top plan view of a printing apparatus with which a tape cassette according to this invention can be utilized.
Figure 2:
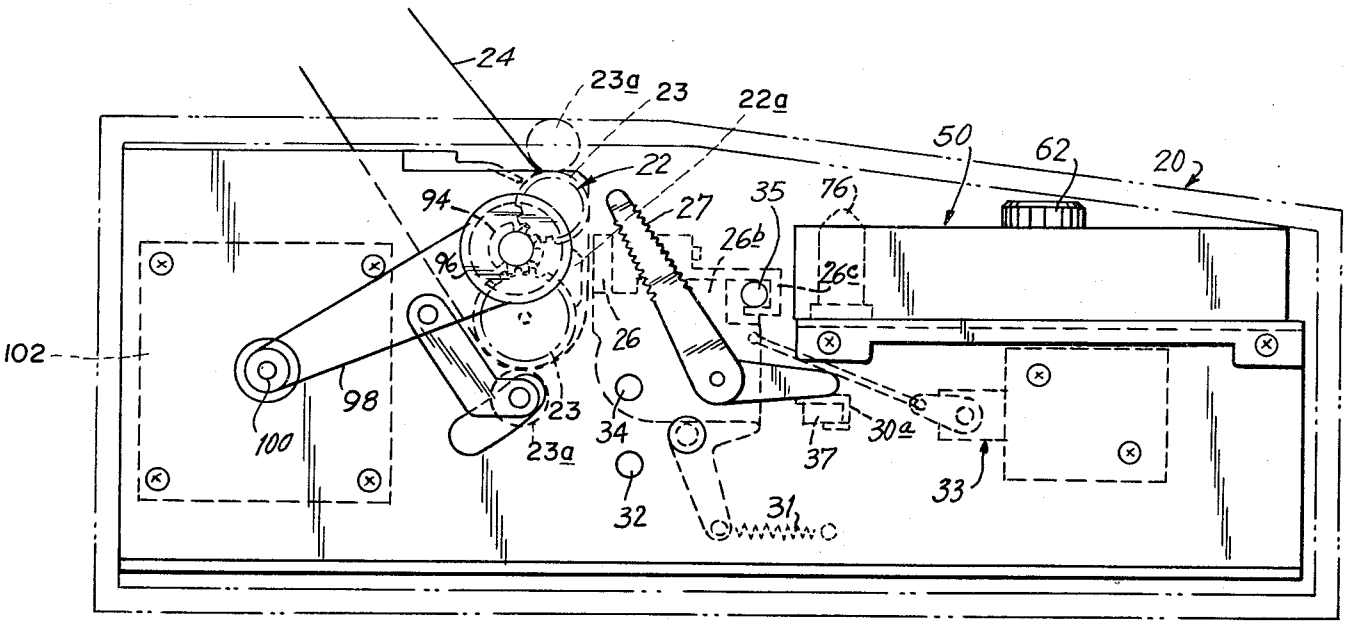
FIG. 2 is a side elevational view, partially in phantom, of a portion of the apparatus of FIG. 1.

Referring to the drawing in detail, and initially to FIGS. 1 and 2 thereof, there is shown a printing apparatus 20 of the thermal transfer type, with which the tape cassette 50 according to this invention is adapted to be used. Such printing apparatus is disclosed in detail in U.S. patent application Ser. No. 06/329,701, filed Dec. 11, 1982 for Printing Apparatus, by Yoshihiro Tsukamura et al., having a common assignee herewith, and the disclosure of which is incorporated herein by reference. In particular, printing apparatus 20 includes a platen 22 rotatably mounted in the apparatus and having a recording sheet of paper 24 circumferentially embraced thereabout along a portion of its length. Sheet 24 is preferably supplied from a continuous paper supply roll (not shown), and is advanced by means of a drive gear 94 which rotates the rollers 23 of platen 22. Drive gear 94, in turn, is rotated through a pulley 96 secured thereto, a belt 98 which rotates the pulley 96 and a drive motor 102 having an output shaft 100 about which belt 98 is also wrapped. Rollers 23 are also shown in FIG. 2 to be engaged by respective pinch rollers **23*a*, such that sheet 24 is engaged between each roller 23 and its associated pinch roller 23*a***.

A thermal head assembly 26 is also provided and a segment **28*a* of recording tape 28 from a cassette 50 is positioned between thermal head assembly 26 and sheet 24 for printing visual information on sheet 24 in response to an information signal. In this regard, platen 22 includes a flat backing surface 22*a* positioned between rollers 23 thereof and against which the thermal head assembly 26 can apply pressure. It is to be noted that the visual information may consist of any combination of words, symbols, characters, patterns, pictures or the like. If tape 28** is formed with a pigment layer covered by a protective layer, such as paraffin, the heating of the tape 28 by thermal head assembly 26 results in the paraffin being melted, whereby the respective portion of the pigment layer is supplied to sheet 24. In this regard, thermal head assembly 26 may include a plurality of heating heads or transducers (not shown) which occupy a width which is smaller than the width of the pigment layer on tape 28, as disclosed in U.S. patent application Ser. No. 06/201,779, filed Oct. 29, 1980, now U.S. Pat. No. 4,378,566 issued Mar. 29, 1983 entitled Apparatus for Producing a Color Picture on Recording Paper, by Yoshihiro Tsukamura, and having a common assignee herewith and incorporated herein by reference, with each heating head preferably being made of a resistive material which is heated by an electrical signal supplied thereto. In the case where a plurality of different colored pigment layers (not shown) are provided on the tape 28, as is well known in the prior art, a plurality of groups of the heating heads or transducers may be provided, as more fully disclosed in the last-mentioned application.

As shown in FIG. 1, printing apparatus 20 includes a head transfer carriage 30 which is capable of moving along the longitudinal direction of platen 22, as shown by arrows a and b, along guide rails 32 and 34. Thermal head assembly 26 is mounted on a support 26*b* which is rotatably mounted on guide rail 34 in close proximity to platen 22 and is adapted to move with head transfer carriage 30 in the lengthwise direction of platen 22. As will be apparent from the discussion hereinafter, thermal head assembly 26 may be biased toward and away from platen 22. In particular, as shown in FIG. 2, a spring 31 normally biases support 26*b*, and thereby thermal head assembly 26, toward platen 22. A solenoid assembly 33 is adapted to retract so as to pull support 26*b*, and thereby thermal head assembly 26, away from platen 22 about guide rail 34 and against the force of spring 31. This latter movement is also effected by a rotatable lever 27 which is connected by means of a linkage (not shown) to a guide bar 35 which, in turn, is rotatably connected only to a projection 26*c* of thermal head assembly 26 and not to head transfer carriage 30, as shown and described more fully in the aforementioned U.S. patent application Ser. No. 06/329,701. Guide bar 35 is adapted to move in a direction perpendicular to arrow a in FIG. 1 in response to manual rotation of lever 27. Thus, when lever 27 is rotated, guide bar 35 is shifted in the aforementioned direction and thermal head assembly 26 is pivoted about guide rail 34 away from platen 22 and against the force of spring 31. Generally, however, lever 27 and guide bar 35 are used for pivoting thermal head assembly 26 away from platen 22 during the loading and unloading of a cassette 50 into the apparatus 20, while solenoid assembly 33 performs this function during operation of the printing mechanism, as will be described hereinafter.

As shown in FIG. 1, tape 28 is wound about a supply reel 36 and a take-up reel 38 of the tape cassette 50 according to this invention, and a segment 28*a* of tape 28 extends between such reels 36 and 38 in the lengthwise direction of platen 22 between tape guide rollers or pins 76 and 80 at opposite ends of the cassette 50, as will be discussed hereinafter in greater detail. The segment 28*a* of tape 28 extending between guide rollers 76 and 80 is further located between a pair of guide rollers or pins 40 and 42 mounted on head transfer carriage 30 at opposite sides of thermal head assembly 26. Further, and as discussed in greater detail in the aforementioned commonly assigned U.S. patent application Ser. Nos. 06/201,779 and 06/329,701, filed Dec. 11, 1982 for Printing Apparatus, by Yoshihiro Tsukamura et al., a first tape press or clamp device 44 for clamping the tape 28 to head transfer carriage 30 during movement of the latter in the direction of arrow b, and a second tape press or clamp device 46 for clamping the tape 28 to the apparatus 20 during movement of head transfer carriage 30 in the direction of arrow a, are provided.

Figure 3:
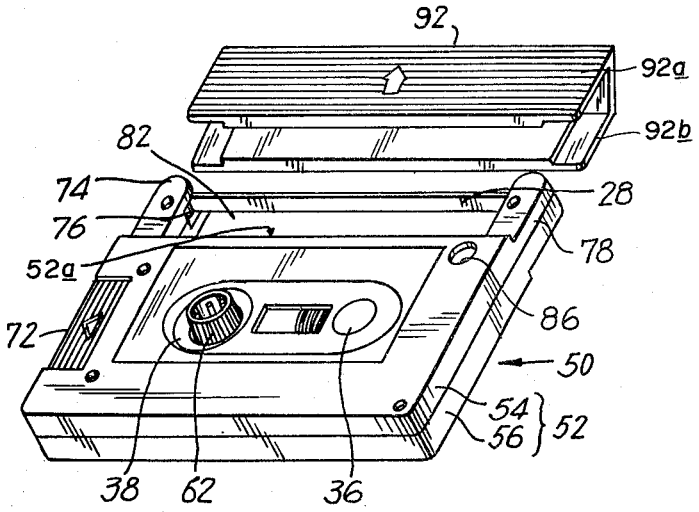
FIG. 3 is a perspective view of a tape cassette according to one embodiment of this invention.
Figure 4:
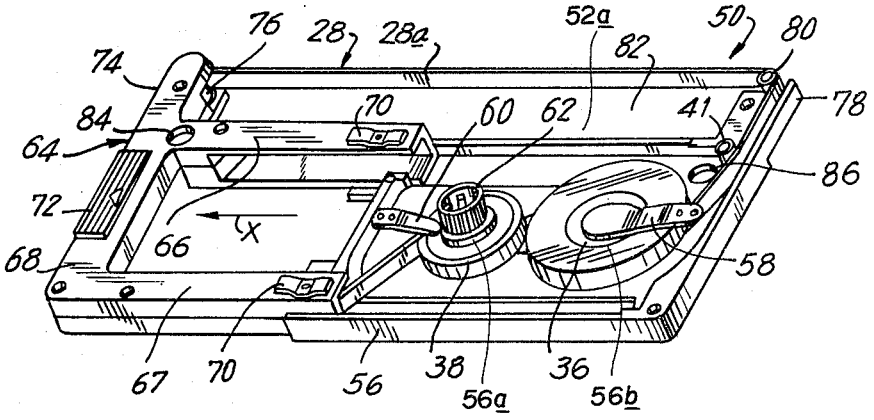
FIG. 4 is a partially broken away, perspective view of the tape cassette of FIG. 3.

Referring now to FIGS. 3 and 4, a tape cassette 50 according to one embodiment of this invention includes a cassette housing 52 comprised of an upper half 54 and a lower half 56 which, when assembled together, form an enclosed space. Supply reel 36 and take-up reel 38 are rotatably mounted on projections 56*b* 56*a* integral with the upper half 54 and/or lower half 56 of cassette housing 52 as in a conventional manner. In order to prevent supply reel 36 and take-up reel 38 from rotating freely within the cassette 50, leaf springs 58 and 60 are secured to the cassette 50 with the free ends thereof exerting an axially biasing force on supply reel 36 and take-up reel 38, respectively. In this manner, tape 28 will not change from its previously set condition in the absence of an external force applied thereto. In this regard, a take-up knob 62 may be secured to take-up reel 38 for winding tape 28 onto take-up reel 38 and thereby overcoming the force applied by leaf spring 60. Further, tape guide rollers or pins 39 and 41 are provided adjacent take-up reel 38 and supply reel 36, respectively, the functions of which will be apparent from the discussion hereinafter.

In accordance with an aspect of this invention, a tape drawing member 64 is provided for adjusting the length of tape 28 extending between supply reel 36 and take-up reel 38. In particular, tape drawing member 64 includes hollow, parallel sliding members 66 and 67 which are connected together at one end thereof by a hollow connecting member 68 and which are slidably received within cassette housing 52 in a direction parallel to segment 28*a* of tape 28. Leaf springs 70 are provided at the free ends of sliding members 66 and 67 and contact either upper half 54 or lower half 56 to provide a relative force between the sliding members 66 and 67 and cassette housing 52 whereby to ensure smooth sliding movement of tape drawing member 64 with respect to cassette housing 52, and a gripping portion 72 is also provided on connecting member 68, whereby the aforementioned sliding movement of tape drawing member 64 into and out of cassette housing 52 can be readily accomplished. Further, a tape guide roller or pin 75 is provided within tape drawing member 64 at the connecting corner between sliding member 67 and connecting member 68.

Further, a hollow projecting portion 74 extends orthogonally from the left-hand edge of tape drawing member 64 and includes tape guide roller or pin 76 at its free end, the latter free end being open along an inwardly facing portion thereof. A similar hollow projecting portion 78 extends from cassette housing 52 at the opposite right-hand edge thereof, as viewed in FIG. 4, and extends parallel to projecting portion 74. Tape guide pin 80 is provided at the free end of projecting portion 78 and the latter free end is open along an inwardly facing portion in opposing relation to the open portion at the free end of projecting portion 74. In this manner, tape 28 extends from supply reel 36, around guide roller 41, through projecting portion 78, around guide rollers 80 and 76, through projecting portion 74 and connecting member 68, around guide roller 75, through sliding member 67, around guide roller 39 and onto take-up reel 38. With this arrangement, the segment 28a extending between guide rollers 76 and 80 is parallel to the nearest edge 52a of cassette housing 52 so as to define a space 82 therebetween. It is to be appreciated that, with such arrangement, the sliding movement of tape drawing member 64 in the direction of arrow X in FIG. 4, which also causes sliding movement of projecting portion 74 and tape guide roller 76, results in a lengthening of the segment 28a of tape 28 extending between guide rollers 76 and 80. In such case, however, the segment 28a of tape 28 remains parallel to the nearest edge 52a of cassette housing 52. If it is desired to shorten segment 28a, tape drawing member 64 is moved in the direction opposite to arrow X in FIG. 4 into cassette housing 52. In such case, take-up knob 62 is rotated to take-up the resultant slack in the tape 28 so as to maintain segment 28a in a taut position between guide rollers 76 and 80.

For positioning tape cassette 50 in printing apparatus 20, as shown in FIG. 1, a guide or positioning aperture 84 is provided on sliding member 66 at the left-hand end of cassette 50 and a guide or positioning aperture 86 is provided in cassette housing 52 at the opposite end of the cassette 50, whereby such apertures 84 and 86 are adapted to be positioned over guide or positioning pins 88 and 90, respectively, of the apparatus 20. In this manner, cassette 50 can be accurately positioned within printing apparatus 20, with tape drawing member 64 being locked in its desired withdrawn position. At such time, supply reel 36 and take-up reel 38 are positioned over corresponding drive shafts (not shown) of the apparatus 20 as is well known in the art. It is to be appreciated that prior to positioning cassette 50 in printing apparatus 20, thermal recording head 26 is biased by lever 27 and guide bar 35 away from platen 22. When thermal recording head 26 is biased away from platen 22, an arm 26a extending therefrom biases the lever 49 of first clamp device 44 so as to rotate the latter in the counter-clockwise direction, as viewed in FIG. 1, away from platen 22. First clamp device 44, in turn, biases the lever 51 of second clamp device 46 so as to also rotate the latter in the counter-clockwise direction, as viewed in FIG. 1, away from platen 22. Accordingly, when tape cassette 50 is positioned within printing apparatus 20, the segment 28a of tape 28 extending between guide rollers 76 and 80 is automatically positioned between thermal head assembly 26 and sheet 24. Thereafter, thermal head assembly 26 is moved by lever 27 in the direction toward platen 22, to the position shown in FIG. 1, into contact with tape 28 to initiate the printing operation.

During operation of printing apparatus 20, thermal head assembly 26 and head transfer carriage 30 move in the direction of arrow a in FIG. 1 by means of drive belt 37 and a motor (not shown), the drive belt 37 being connected to head transfer carriage 30 by a connecting member 30a. At such time, second tape clamp device 46 prevents the tape segment 28a from moving so that thermal head assembly 26 prints one horizontal line of information on sheet 24. At the end of the line, solenoid assembly 33 pivots thermal head assembly 26 away from platen 22 but to a lesser extent then lever 27. Accordingly, arm 26a of thermal head assembly 26 does not bias first tape clamp device 44 away from platen 22. Thereafter, when thermal head assembly 26 and head transfer carriage 30 are moved in the direction of arrow b to their original positions, as shown in FIG. 1, first tape clamp device 44 on head transfer carriage 30 pulls a new segment 28a of tape 28 from supply reel 36. The excess slack in the tape 28 is taken up by take-up reel 38 which is rotated by a motor (not shown) as is well known in the art. When the position shown in FIG. 1 is reached, solenoid assembly 33 releases thermal head assembly 26 so that the latter is once again brought into contact with tape 28 for printing the next line. At the same time, sheet 24 is advanced one line by motor 102 through the aforementioned arrangement.

Accordingly, unlike the prior art, tape cassette 50 is merely positioned within the apparatus 20 on guide pins 88 and 90, and the tape segment 28a is then automatically loaded between thermal recording head 26 and sheet 24. Further, the tape cassette 50 according to this invention can be utilized with printing apparatus having different dimensions, that is, printing apparatus having platens of different lengths. In this manner, if tape cassette 50 is removed from printing apparatus 20 of FIG. 1 and positioned within a printing apparatus having a platen of a smaller length, tape drawing member 64 is merely pushed slightly back into cassette housing 52. However, at such time, tape 28 extending between supply reel 36 and take-up reel 38 slackens. Accordingly, take-up knob 62 is rotated to take up such slack whereby the segment 28a of tape 28 extending between guide rollers 76 and 80 is maintained in a taut configuration.

Further, as shown in FIG. 3, the widths of projecting portion 74 of tape drawing member 64 and projecting portion 78 of cassette housing 52 are less than the width of cassette housing 52. In this manner, a cover 92, which is formed as an elongated U-shaped member can be positioned over projecting portions 74 and 78 and segment 28a of tape 28 extending between guide rollers 76 and 80 for protecting segment 28a from any damage. For example, the legs 92a and 92b of cover 92 may be biased apart to fit over projecting portions 74 and 78 and then released to clamp or grip such projecting portions 74 and 78.

Figure 5:
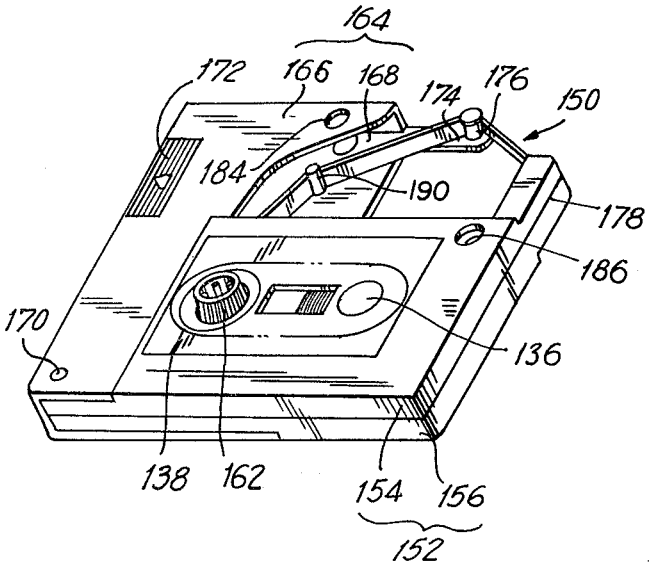
FIG. 5 is a perspective view of a tape cassette according to another embodiment of this invention.
Figure 6:
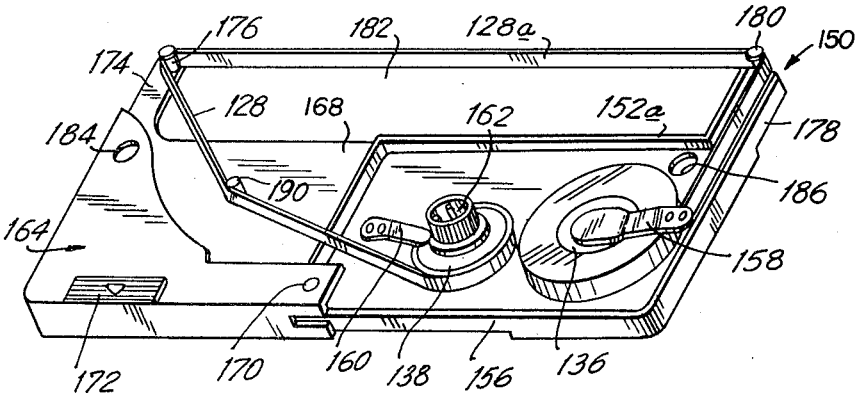
FIG. 6 is a partially broken away, perspective view of the tape cassette of FIG. 5.

Referring now to FIGS. 5 and 6, a tape cassette 150 according to another embodiment of this invention includes a cassette housing 152 comprised of an upper half 154 and a lower half 156 forming an enclosed space therebetween. As with tape cassette 50 of FIG. 3, a tape cassette 150 includes a supply reel 136 and a take-up reel 138 rotatably mounted within cassette housing 152. A take-up knob 162 is also secured to take-up reel 138 in the same manner as the relation between take-up knob 62 and take-up reel 38 of FIG. 3. Further, as with the embodiment of FIG. 3, leaf springs 158 and 160 are associated with supply reel 136 and take-up reel 138 for providing a back tension thereto so as to prevent such reels 136 and 138 from freely rotating. Tape cassette 150 also includes a hollow projecting portion 178 having a guide pin 180 at its free end about which a tape 128 from supply reel 136 is wrapped. In addition, a guide or positioning aperture 186 is provided in tape cassette 150 adjacent the connected end of projecting portion 178 for use in aligning the cassette 150 within the printing apparatus 20.

A tape drawing member 164, which is comprised of an upper half 166 and a lower half 168 and which, when assembled, provide a space therebetween, is pivotally connected at one end thereof to the lower left-hand corner of cassette housing 152, as viewed in FIG. 5, by a pivot pin 170. The opposite free end of tape drawing member 164 includes a projecting portion 174 having a guide roller or pin 176 secured to the free end thereof. Further, in a similar manner to tape drawing member 64 of the tape cassette 50 of FIG. 3, tape drawing member 164 includes a gripping portion 72 for pivoting tape drawing member 164 about pivot pin 170, and a guide aperture 184 at its free end which, along with guide aperture 186, functions to align the tape cassette 150 within the printing apparatus 20. The lower half 168 of tape drawing member 164 also has a guide pin 190 thereon. It is to be appreciated that guide pin 190 is positioned on lower half 168 so as not to interfere with the pivotal movement of tape drawing member 164 with respect to cassette hosing 152. Accordingly, tape 128 extends from supply reel 136, through projecting portion 178, about guide rollers 180, 176 and 190, and back around take-up reel 138. When tape drawing member 164 is pivoted to the opened position shown in FIG. 6, guide pin 176 guides and withdraws tape 128 to a printing position parallel to the nearest edge 152*a* of cassette housing 152 to thereby define a space 182 therebetween. In this manner, when tape drawing member 164 is pivoted to its opened position, tape cassette 150 can be positioned within printing apparatus 20 with guide apertures 184 and 186 being positioned over guide pins 88 and 90 of printing apparatus 20, and with a tape segment 128*a* being positioned between thermal head assembly 26 and sheet 24.

Figure 7:
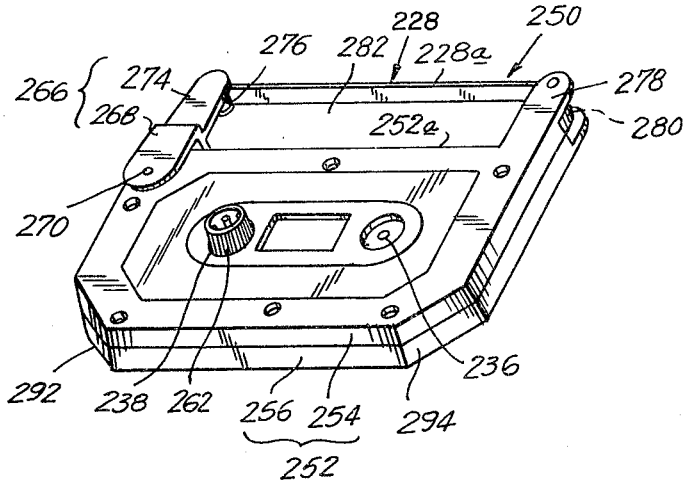
FIG. 7 is a perspective view of a tape cassette according to another embodiment of this invention.
Figure 8:
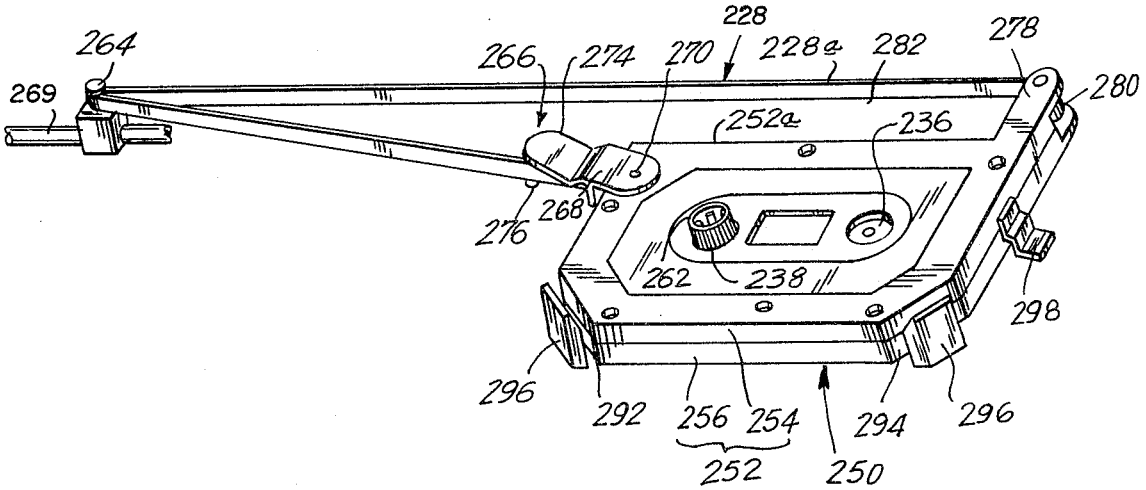
FIG. 8 is a perspective view of the tape cassette of FIG. 7, illustrating the operation thereof.

Referring now to FIGS. 7 and 8, a tape cassette 250 according to another embodiment of this invention includes a cassette housing 252 formed of an upper half 254 and a lower half 256 which define a space therebetween. A rotatable supply reel 236 and a rotatable take-up reel 238 are also provided therein, with a take-up knob 262 being secured to take-up reel 238. A hollow projecting portion 278 having a guide roller or pin 280 at its free end integrally extends from one end of cassette housing 252 in much the same manner as projections 78 and 178 of the tape cassettes 50, 150 of FIGS. 3 and 5, respectively. Further, the lower left-hand and right-hand corners of cassette housing 252, as viewed in FIG. 7, contain bevelled corner portions 292 and 294. In this manner, when tape cassette 250 is positioned within a printing apparatus 20, guide plates 296 of the apparatus 20 cooperate with bevelled portions 292 and 294 to accurately position tape cassette 250 within the apparatus 20. A leaf spring 298 of the apparatus 20 also presses against a side of cassette housing 252 for performing the same function.

The edge of tape cassette 250 opposite projecting portion 278 has a guide member 266 pivotally secured thereto. Guide member 266 includes a first bifurcated portion 268 pivotally secured to the upper left-hand corner of tape cassette 250 of FIG. 7 by a pivot pin 270, and a guide portion 274 extending therefrom, the latter portion 274 including a guide roller or pin 276 at the free end thereof for guiding the tape 228 extending between reels 236 and 238. Accordingly, tape 228 extends from supply reel 236, through projection 278, around guide rollers 280 and 276, around pivot pin 270 and onto take-up reel 238.

Unlike the tape cassette 50 and 150 of FIGS. 3 and 5, the tape 228 is not withdrawn by means of a tape drawing member 64 attached to the tape cassette 50, but rather, by a separate tape drawing pin 264 connected to a sliding rod 269 of the apparatus 20. In operation, tape drawing pin 264 is positioned within the space 282 between segment 228*a* extending between guide rollers 276 and 280 and the nearest edge 252*a* of cassette housing 252 for withdrawing the tape segment 228*a* along and parallel to platen 22, as shown in FIG. 8. In this manner, tape segment 228*a* is maintained parallel to the longitudinal or lengthwise direction of platen 22 when cassette 250 is inserted in the printing apparatus 20. In such case, guide member 266 and, in particular, guide roller 276 thereof guides the tape 228 extending between take-up reel 238 and tape drawing pin 264. As with tape cassette 50 of FIG. 3, it should be appreciated that tape cassette 250 of FIG. 7 may be used with different apparatus having platens of different lengths.

Figure 10:
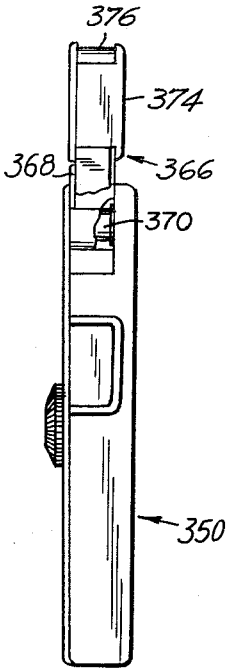
FIG. 10 is an end elevational view of the tape cassette of FIG. 9.
Figure 9:
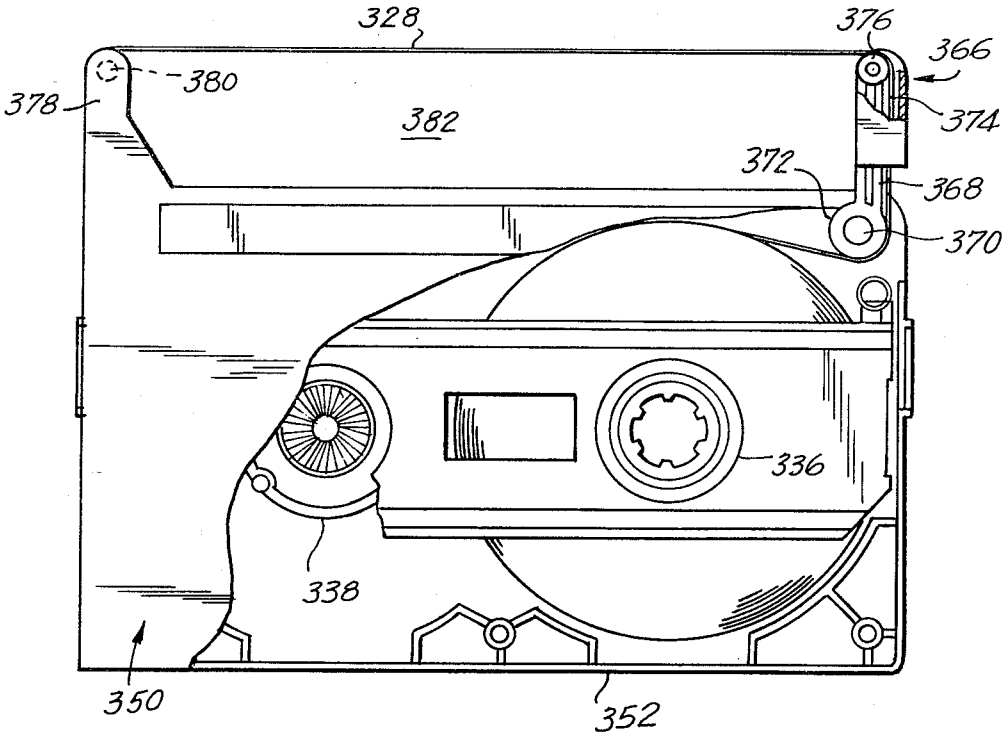
FIG. 9 is a partially broken away, top plan view of a modification of the tape cassette of FIG. 7.

Referring now to FIGS. 9 and 10, a cassette 350, which is a modification of the cassette 250 of FIG. 7, has a housing 352 which includes a modified guide member 366 having a first portion 368 pivotally secured about a pivot pin 370 to a corner of tape cassette 350 adjacent supply reel 336, rather than take-up reel 338. The pivoted end of guide member 366 includes an enlarged cylindrical end 372 about which the tape 328 from supply reel 336 extends. A hollow guide portion 374 integrally extends from first portion 368 and has a guide roller or pin 376 at the free end thereof for guiding the tape 328 extending between reels 336 and 338. Cassette 350 further has a guide roller 380 and a projecting portion 378 which define a space 382 therebetween.

As an alternative manner of operation to that described above with respect to cassette 250 of FIG. 7, the tape 328 of cassette 350 may be withdrawn by thermal head assembly 26 and head transfer carriage 30 during each line print operation. As an example, when thermal head assembly 26 begins to print a line on sheet 24, second tape clamp device 46 prevents the tape 328 from moving. Thermal head assembly 26 thereafter moves in the direction of arrow a in FIG. 1 to print one horizontal line on sheet 24 and in doing so, moves past guide member 366 and draws the tape 328 from supply reel 336 along therewith. At the end of a line, solenoid assembly 33 pivots thermal head assembly 26 away from platen 22, as described above with respect to the cassette 50 of FIG. 3. When thermal head assembly 26 moves in the direction of arrow b in FIG. 1 to its original position and past guide member 366 in the reverse direction, the slack that results in the tape 328 is taken up by take-up reel 338 which is driven by a suitable motor drive arrangement (not shown) as is well known in the art.

It should be appreciated that, with all of the above embodiments of this invention, a tape cassette is provided for quickly and easily positioning of a tape within a thermal printing apparatus. In addition, in all of the above tape cassettes according to this invention, the segment of tape extending between the supply and take-up reels, in the inoperative condition of the cassette, as shown in FIGS. 3, 5 and 7, is adapted to be lengthened, as shown in FIGS. 4, 6 and 8, for use in the printing apparatus. When it is desired to shorten the length of the tape, the tape drawing members of the cassettes of FIGS. 3 and 5 are returned to their inoperative positions, as shown in FIGS. 4 and 6. The tape used with the cassettes of FIGS. 7 and 9 is returned automatically by the thermal printing apparatus. Since a slack results in the segments of tape extending between the supply and take-up reels in the cassettes of FIGS. 3 and 5 at such time, the take-up knobs are rotated to rewind the tape onto the take-up reel. Further, in each of the embodiments, a guide pin 76, 176, 276 or 376 is movably mounted, either in a sliding relation or pivotal relation, on the cassette housing for guiding the segment of tape during the operative and inoperative conditions of the tape cassette.

Having described specific preferred embodiments of this invention with reference to the accompanying drawing, it is to be understood that the invention is not limited to those precise embodiments, and that various changes and modifications may be effected therein by one skilled in the art without departing from the scope or spirit of the invention as defined in the appended claims.

What is claimed is:

1. A tape cassette for use with a printing apparatus, comprising:

housing means including a first projecting portion at one side thereof;

first and second reels rotatably mounted in said housing means;

a tape having a pigment thereon wound about said reels and having a segment extending between said reels, the length of said segment being adjustable;

tape drawing means slidably moveable within said housing means for adjusting the length of said segment and including at least one sliding member moveable within said housing means in a direction parallel to said segment of tape and having a portion thereof always positioned within said housing means and having an end section, a connecting member connected to said end section, and a second projecting portion having a free end and extending from said connecting member at an opposite side of said housing means and being substantially parallel to said first projecting portion; and first guide means attached to said free end of the second projecting portion of said tape drawing means for slidably moving therewith in said direction parallel to said segment of tape with respect to said housing means as the tape drawing means moves within said housing means for guiding said segment of tape and for adjusting the length thereof used for printing.

2. A tape cassette according to claim 1; in which said first and second projecting portions are hollow, said first projecting portion has a free end, and further including second guide means connected to the free end of said first projecting portion, said segment of tape extending between said first and second guide means and a space being defined between said segment and said housing means.

3. A tape cassette according to claim 2; in which said tape extends from said first reel, through said first projecting portion, around said second guide means, around said first guide means, through said tape drawing means and onto said second reel.

4. A tape cassette according to claim 2, further including cover means cooperating with said first and second projecting portions for protecting said segment of tape.

5. A tape cassette according to claim 4, in which said cover means is of a substantially U-shaped elongated configuration for gripping said first and second projecting portions.

6. A tape cassette according to claim 1, further including biasing means for providing a relative force between said tape drawing means and said housing means to ensure smooth sliding movement of said tape drawing means with respect to said housing means.

7. A tape cassette according to claim 1, further including biasing means for providing a back tension to at least one of said first and second reels to prevent said second reel from freely rotating.

8. A tape cassette for use with a printing apparatus, comprising:

housing means including a first projecting portion at one side thereof;

first and second reels rotatably mounted in said housing means;

a tape having a pigment thereon wound about said reels and having a segment extending between said reels for use in printing, the length of said segment being adjustable;

tape drawing means pivotally connected to said housing means and pivotable to an operative position for adjusting the length of said segment, said tape drawing means including a tape drawing member having one corner thereof pivotally connected at an opposite side of said housing means and a second projecting portion extending from an opposite corner of said tape drawing member, said second projecting portion having a free end and being arranged substantially parallel to said first projecting portion when said tape drawing means is pivoted to said operative position; and first guide means attached to the free end of said second projecting portion of said tape drawing means for pivotally moving therewith with respect to said housing means so as to guide said segment of tape during a printing operation with said cassette positioned in said apparatus and so as to adjust the length of said segment of tape used for printing.

9. A tape cassette according to claim 8; in which said first projecting portion is hollow and has a free end, and further including second guide means connected to the free end of said first projecting portion, said segment of tape extending between said first and second guide means and a space being defined between said segment and said housing means.

10. A tape cassette for use with a printing apparatus, comprising:

housing means having a first projecting portion with a free end at one side thereof;

first and second reels rotatably mounted in said housing means;

a tape having a pigment thereon wound about said reels and having a segment extending between said reels, the length of said segment being adjustable; and guide means including a second projecting portion having a first end pivotally connected to an opposite side of said housing means and having a second, opposite free end pivotable with said second projecting portion for guiding said segment of tape during a printing operation with said cassette positioned in said apparatus, with said segment of tape extending between said free end of said first projecting portion and said second free end so that a space is defined between said segment and said housing means.

11. A tape cassette according to claim 10, in which said guide means includes guide pin means connected to said second, opposite free end.

* * * * *